US006151960A

United States Patent [19]

Taylor et al.

[11] Patent Number: 6,151,960

[45] **Date of Patent: *Nov. 28, 2000**

[54] METHOD OF DETERMINING CHARACTERISTICS OF A ROTARY DRAG-TYPE DRILL BIT

[75] Inventors: Malcolm Roy Taylor, Gloucester; Andrew Murdock, Stonehouse, both of United Kingdom

[73] Assignee: Camco International (UK) Limited, Stonehouse, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 09/160,002

[22] Filed: Sep. 24, 1998

[30] Foreign Application Priority Data

Aug. 4, 1998 [GB] United Kingdom ..... 9816825

[51] Int. Cl.[7] ..... E21B 47/00

[52] U.S. Cl. ..... 73/152.52; 73/152.59; 175/427

[58] Field of Search ..... 73/152.01, 152.03, 73/152.43, 152.51, 152.52, 152.54, 152.59; 175/327, 427

[56] References Cited

U.S. PATENT DOCUMENTS

| | | | |
|---|---|---|---|
| 4,475,606 | 10/1984 | Crow . | |
| 4,694,686 | 9/1987 | Fildes et al. | 73/104 |
| 4,928,521 | 5/1990 | Jardine | 73/152.43 |
| 5,131,478 | 7/1992 | Brett et al. . | |
| 5,216,917 | 6/1993 | Detournay | 73/152.59 |

FOREIGN PATENT DOCUMENTS

| | | |
|---|---|---|
| 2 125 086 | 8/1982 | United Kingdom . |
| 2 241 266 | 8/1991 | United Kingdom . |

OTHER PUBLICATIONS

J.D. Barr Optimisation of Radial Distribution of Stratapax (T1) Cutters in Rock Drilling Bits Paper presented at Energy–sources Technology Conference, New Orleans, Feb. 1980, ASME Petroleum Division.

DBS Literature entitled "TD 13/TD 19 Drill Bit Series", undated but believed to date from about 1991 (7 Pages).

*Primary Examiner*—Max Noori

*Attorney, Agent, or Firm*—Jeffery E. Daly

[57] ABSTRACT

A method of determining wear characteristics of a rotary drag-type drill bit comprises the steps of: determining the location and shape of a datum profile for the cutters on the bit body: determining the location and shape of a reference profile located inwardly of the datum profile; and ascertaining the volume of superhard material in the cutters between the datum profile and the reference profile. The volume of superhard material in the cutters at discrete radial locations is then plotted against the radial distance of the material from the axis of rotation of the bit body. The predicted wear rate $WR_r$ of superhard material at radius r is also calculated as a function of the volume and the predicted wear rate is plotted against r. The type and location of the cutters may then be modified, if necessary, to give a wear rate which is substantially constant across the radius of the drill bit.

26 Claims, 4 Drawing Sheets

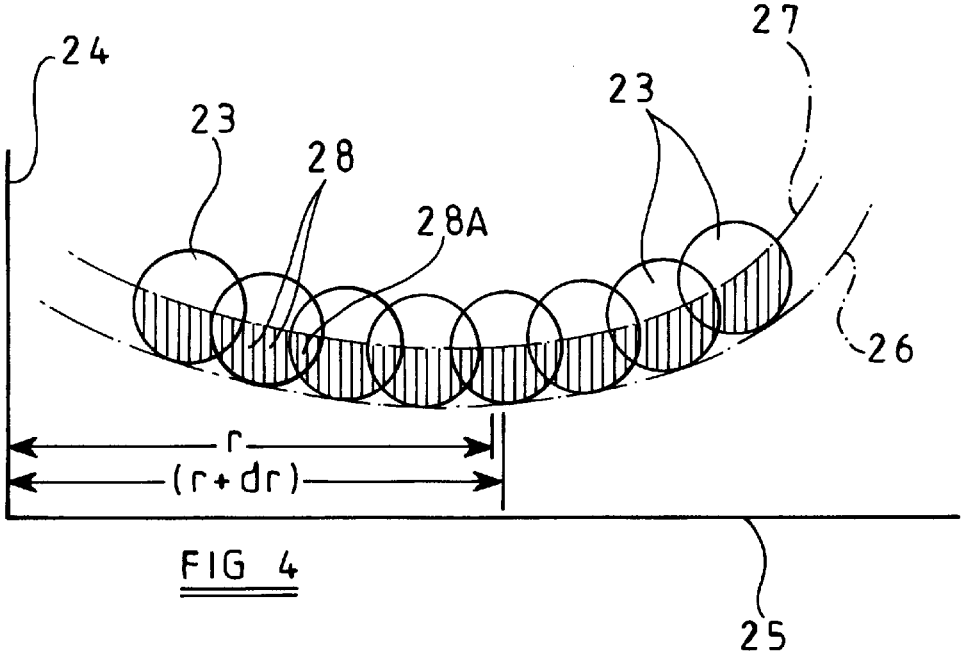
FIG 4
FIG 5
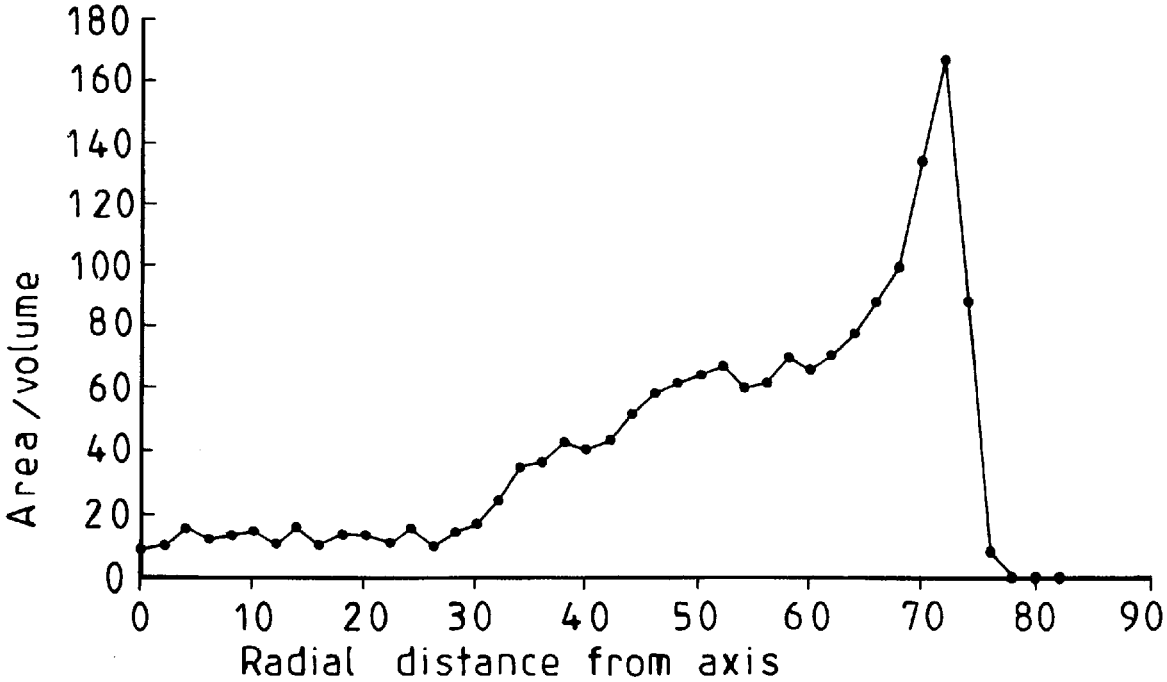

METHOD OF DETERMINING CHARACTERISTICS OF A ROTARY DRAG-TYPE DRILL BIT

BACKGROUND OF THE INVENTION

1. Field of the Invention

The invention relates to rotary drag-type drill bits for use in drilling holes in subsurface formations and of the kind where cutting structures are mounted on a bit body having an axis of rotation. One common form of bit has a shank for connection to a drill string, a plurality of circumferentially spaced blades on the bit body extending outwardly away from the central axis of rotation of the bit, and a plurality of separate cutting elements mounted along each blade. A passage in the bit body supplies drilling fluid to nozzles in the surface of the bit for cleaning and cooling the cutters.

2. Description of Related Art

The invention is particularly, but not exclusively, applicable to drill bits in which some or all of the cutters are preform cutters formed, at least in part, from polycrystalline diamond or other superhard material. One common form of cutter comprises a tablet, usually circular or part-circular, made up of a superhard table of polycrystalline diamond, providing the front cutting face of the cutter, bonded to a substrate which is usually of cemented tungsten carbide.

The invention is also applicable to drill bits where the cutting structures comprise particles of natural or synthetic diamond, or other superhard material, embedded in a body of less hard material. The cutting structures may also comprise regions of a larger substantially continuous body comprising particles of superhard material embedded in a less hard material.

The bit body may be machined from solid metal, usually steel, or may be molded using a powder metallurgy process in which tungsten carbide powder is infiltrated with a metal alloy binder in a furnace so as to form a hard matrix.

The outer extremities of the cutters or other cutting structures on the drill bit define an overall cutting profile which defines the surface shape of the bottom of the borehole which the bit drills. Preferably the cutting profile is substantially continuous over the leading face of the bit so as to form a comparatively smooth bottom hole profile.

It is desirable, when designing a drill bit of the above kind, to be able to make a reasonably accurate prediction of the rate of wear of the cutting structures and, in particular, to compare the likely rates of wear of different cutting structure arrangements. The present invention provides an improved method for doing this.

It is common practice to use computers to model and analyze bit designs and methods of analysis have previously been proposed and used for predicting cutter wear. Such analysis is usually carried out by constructing a computerized model or representation of a particular bit design, a computer algorithm being designed to perform a series of steps on the computerized model of the bit in order to predict cutter wear. However, while existing methods may provide useful comparisons in wear rate between designs of bit where cutters are of the same type, size and shape, the existing methods cannot provide useful wear comparisons between bit designs having different cutter types, sizes or shapes. Existing methods are also usually dependent on the rate of penetration of the drill bit.

Also, existing methods generally assume that the wear rate of the cutting structures is substantially constant over the life of the bit, which may not be the case.

The present invention therefore sets out to provide a new method of determining the wear characteristics of a rotary drag-type bit which is independent of the type, size and shape of the cutting structures, and is also independent of rate of penetration (ROP). In a preferred method, other factors affecting wear rate may also taken be into account. Essentially, the method consists in evaluating for each design of drill bit a volume of cutting structure material, for example the volume of diamond or other superhard material, which is "available" to be worn away, irrespective of the shapes and dimensions of the cutting structures which provide such material, the wear rate being a function of such volume. The method is also applicable to determine the volume of cutter material which has actually been worn away in an actual used drill bit, so that the wear characteristics of an actual bit design can be compared with those of another actual bit, or with a proposed new design of bit.

SUMMARY OF THE INVENTION

According to the invention there is provided a method of determining wear characteristics of a rotary drag-type drill bit of the kind comprising cutting structures on a bit body, the method comprising the steps of: determining the location and shape of a datum profile for the cutting structures: determining the location and shape of a reference profile located inwardly of the datum profile with respect to the bit body; and ascertaining a volume of cutting structure material between the datum profile and the reference profile.

As a first approximation, it may be assumed that cutter material wears away at a reasonably constant volume rate when used to drill a given type of formation, the volume of material available to be worn away is a measure of the potential useful life of a bit. Thus, generally speaking, a bit having a greater volume of "available" cutter material will have a longer life than a bit having a smaller volume of available material, irrespective of the shape, size and configuration of the cutters.

Preferably the datum profile is no closer to the bit body than the outer extremities of the cutting structures, and may be generally tangential to the outer extremities of at least some of said cutting structures.

The cutting structures may include discrete cutters separately mounted on the bit body. For example, each cutter may comprise a layer of superhard material bonded to a less hard substrate, and said volume of cutter material may comprise the volume of the superhard material on said cutters between the datum profile and the reference profile.

Alternatively each cutter may comprise particles of superhard material embedded in a body of less hard material. In this case said volume of cutter material may comprise the volume of the superhard material in said cutters between the datum profile and the reference profile.

The cutting structures may include cutters of both of the last-mentioned kinds.

The cutting structures may also comprise regions of a larger substantially continuous body of cutting material extending over at least a part of the bit body and comprising particles of superhard material embedded in a less hard material. In this case said volume of cutter material comprises the volume of the superhard material in said regions between the datum profile and the reference profile.

In any of the above arrangements the superhard material may comprise particles of natural or synthetic diamond.

In addition to the basic information regarding total cutter material volume which is provided by the method, further projected wear information may be obtained by correlating the volume of cutter material, and corresponding wear rate, with distance from the axis of rotation of the bit body, since a portion of cutter material which is further from the bit axis will travel a greater distance during drilling than a portion of cutter material which is nearer the bit axis, and the further cutter material will therefore wear at a faster rate. It is for this reason that drag-type drill bits generally have increasing numbers of cutters, or larger cutters, with distance from the bit axis.

Accordingly, the method according to the invention preferably includes the further step of correlating said volume of cutting structure material in said cutting structures with distance of said material from the axis of rotation of the bit body.

For example, the method may include the step of calculating said volume of cutting structure material between the reference profile and the datum profile and within a cylindrical space of inner radius r and outer radius (r+δr), with respect to the axis of rotation of the drill bit, and plotting said volume against r.

The method may include the step of calculating the predicted wear rate $WR_r$ of cutting structure material at radius r as a function of the volume and plotting said predicted wear rate against r.

The method may include the further step of multiplying the calculated predicted wear rate by one or more correction factors selected from correction factors to account for: wear flat area, superhard material abrasion-resistance, less hard material abrasion resistance, shape factor, and superhard material orientation.

Said correction factors may be adjusted, by modification of the bit design, to produce a desired curve of predicted wear rate plotted against r.

In another application of the method the curve of predicted wear rate plotted against r is compared with a corresponding curve of actual wear rate plotted against r for an actual drill bit, and the bit design is then modified in a manner to address wear patterns in the predicted wear curve which are uncharacteristic of the actual drill bit.

In any of the above-described versions of the method according to the invention the location and shape of the reference profile may be determined by applying an offset to the datum profile. For example, the reference profile may be offset from the datum profile by distances which are equal for all parts of the datum profile.

Alternatively, the location and shape of the reference profile may be measured from the cutters of an actual worn drill bit, the datum profile being determined from a stored representation of the datum profile of the same bit before such wear occurred.

In another alternative the surface profile of the bit body itself is used as the reference profile.

The shape and location of the reference profile may correspond to a total wear flat area of the cutting structures which would represent the limit of practical use of an actual drill bit according to the design.

In an actual drill bit it is common practice to have more cutters towards the center of the bit than is necessary to accommodate wear. The reason for this is to provide adequate cutter coverage and redundancy in the central region. Cutter wear towards the center of the bit is therefore usually minimal. Since wear in this region is not critical, therefore, it may possibly be ignored in the method according to the present invention.

It is however very important that a drill bit does not "lose gauge" and drill an undersize hole. For this reason it is common practice to add more face cutters and gauge cutters near the gauge of the drill bit. In determining the theoretical reference profile, therefore, it may be desirable to reduce the offset towards the gauge region.

In order to take into account variation in the wear rate as the cutting structures wear, the steps of the method may be repeated, the datum profile of each subsequent series of steps having the shape and location of the reference profile in the immediately preceding series of steps.

As previously mentioned, the steps of the method according to the invention, and the representations of the elements on which the steps are performed, may be generated by a computer program.

BRIEF DESCRIPTION OF THE DRAWINGS

FIG. 4 is a diagram showing two-dimensional representations of the cutters on the drill bit, and of the cutting and reference profiles, projected on to a single plane for the purposes of analysis.

FIG. 5 is a graph showing cutter material area/volume plotted against distance from the axis of rotation of the bit.

DETAILED DESCRIPTION OF THE PREFERRED EMBODIMENTS

Figure 1:
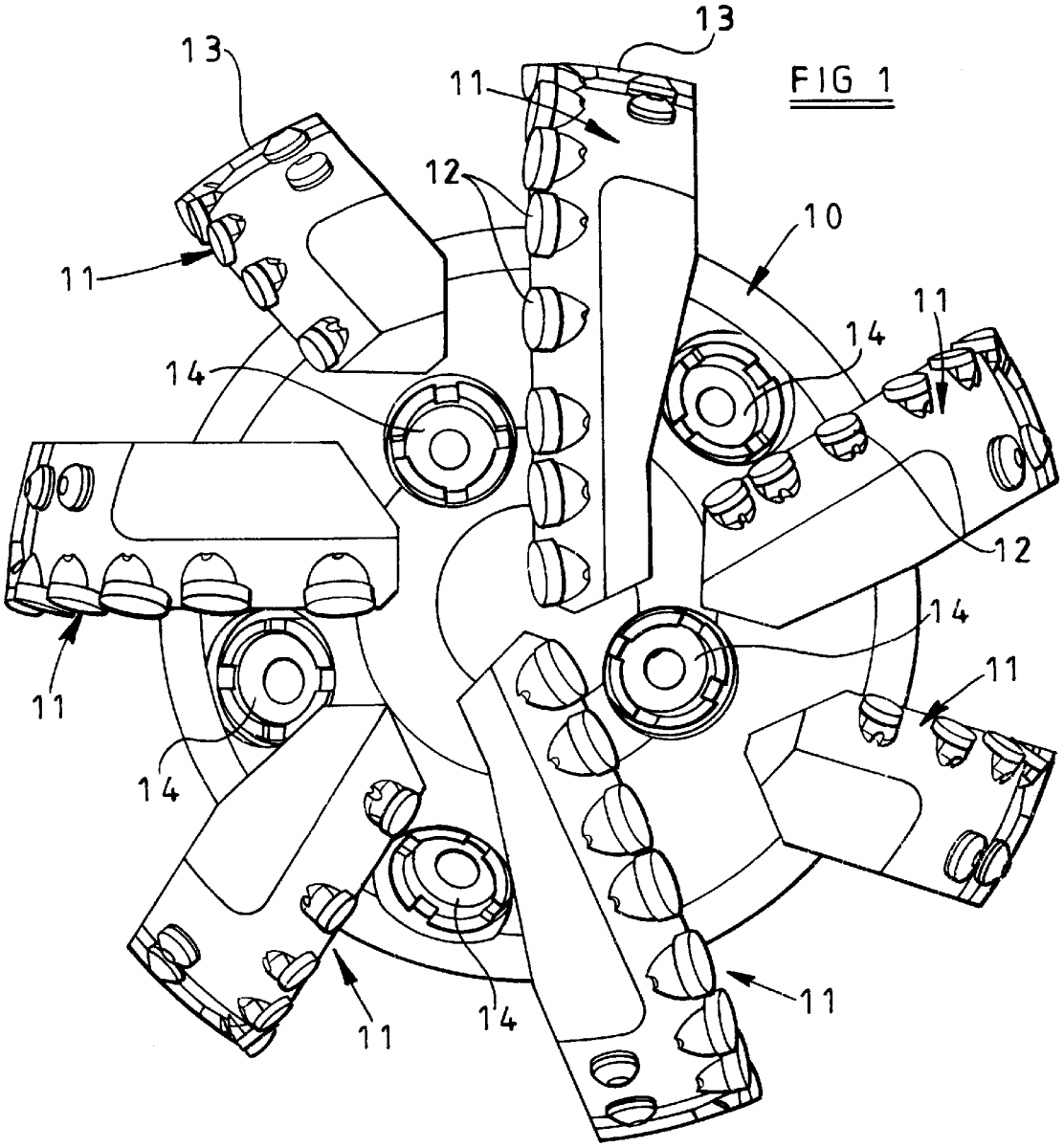
FIG. 1 is an end view of one kind of drill bit of the general type to which the invention is applicable.
Figure 2:
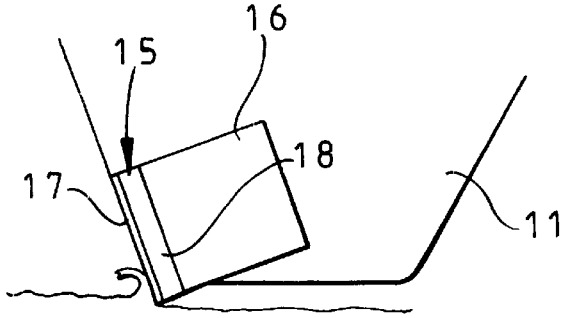
FIG. 2 is a diagrammatic section through a typical preform cutter mounted on the drill bit.

Referring to FIGS. 1 and 2, there is shown an end view of one kind of full bore drill bit of a type to which the method of the present invention may be applied. The bit body 10 is typically machined from steel and has a threaded shank (not shown) at one end for connection to the drill string. The operative end face of the bit body is formed with a number of blades 11 radiating outwardly from the central area of the bit, the blades carrying cutters 12 spaced apart along the length thereof.

The bit gauge section includes kickers 13 which contact the walls of the borehole in use, to stabilize the bit in the borehole. A central passage (not shown) in the bit body and shank delivers drilling fluid through nozzles 14 mounted in the bit body, in known manner, to clean and cool the cutters.

Each cutter 12 comprises a preform cuffing element 15 mounted on a carrier 16 in the form of a stud which is secured in a socket in the blade 11 (see FIG. 2). Each cutting element 15 comprises a circular tablet having a front facing table 17 of polycrystalline diamond, providing the front cutting face of the element, bonded to a substrate 18 of cemented tungsten carbide, the substrate being in turn bonded to the carrier 16.

It will be appreciated that this is only one example of many possible variations of the type of bit and cutter to which the method of the present invention is applicable.

For example the cutting structures on the drill bit may be impregnated cutters in which particles of natural or synthetic diamond, or other superhard material, are embedded in bodies of less hard material, such as tungsten carbide. Such impregnated cutters may be combined with preform cutting elements of the kind shown in FIG. 1. For example, some of the preform cutters may have associated therewith impregnated back-up cutters at the same radius and to the rear of the preform cutters with respect to the direction of rotation.

The method may also be applied to drill bits where the surface of the bit body are covered with a substantially continuous layer of cutter material comprising natural or synthetic diamond or other superhard particles embedded in a layer of less hard material.

The object of the method according to the invention is to determine the volume of cutter material which is available to be worn away between datum profile of the bit (which may conveniently be the cutting profile) and a reference profile which maybe the wear profile of the actual worn bit, or a theoretical wear profile representing a stage in the wear of a proposed bit design.

For the purposes of the invention, the available volume of cutter material which is determined may be the whole of the cutter material, comprising the polycrystalline diamond layer, the substrate and, perhaps, also the carrier in the case of a preform cutter, or both the superhard material and the matrix in which it is embedded in the case of an impregnated cutter. However, the critical material from the point of view of wear rate is the polycrystalline diamond or other superhard material. In preferred methods according to the invention, therefore, the cutter material under consideration is the polycrystalline diamond or other superhard material alone.

Another factor which may affect the rate of wear of a cutter is the shape and size of the wear flat which is formed on the cutter in use, and the rate at which the wear flat develops. The shape and size of the wear flat will vary according to the back rake of the cutter and the cutter assembly geometry generally, and the method according to the invention may therefore be refined to take this into account. Another aspect is that as the wear flat develops the heat generated in the cutter rises and the wear resistance of the diamond decreases as a result of this rise in temperature. The method may therefore be modified to allow for this factor.

Other factors may also affect the rate of wear of a cutter, such as the abrasion resistance of the polycrystalline diamond or other superhard material, the abrasion resistance of the less hard material which forms the substrate, or in which the superhard diamond particles are embedded in an impregnated cutter type of drill bit, and the shape and orientation of the cutting structure. As will be described, in the method according to the present invention correction factors may be applied to take into account the effect of these parameters on wear rate.

The steps of one particular method according to the present invention will now be described. For the purposes of explanation and clarification, the steps of the method will be described in physical terms but in practice a suitable computer program is written to carry out computerized versions of the steps described and to perform the required analysis.

EXAMPLE OF THE METHOD

Figure 3:
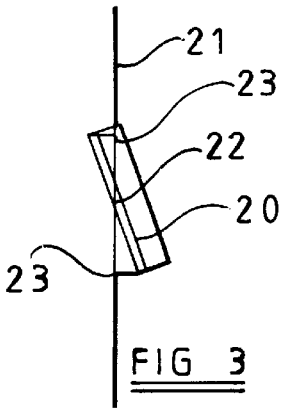
FIG. 3 shows diagrammatically the projection of the shape of the cutter on to a plane.

In this example to be described in relation to FIGS. 3 to 5 it is assumed that the cutting structures are preform cutters of the kind shown in FIG. 2 although, as previously explained, the method is also applicable to other types of cutting structure.

A computerized representation of the shapes of the cutters of a proposed or existing design of drill bit is created, including the locations of the cutters and their orientations with respect to the bit axis. It is common practice to create such computerized representations of drill bit designs for various purposes and there are program available for creating such representations. The computerized representation of the design does not, of course, have to be a visual representation, but it will be referred to in such terms for the purpose of explanation of the method.

Referring to FIG. 3, a plane 21 is created which passes through the bit center axis and the center 22 of the polycrystalline diamond layer of each cutter 20. The shape of the cutter 20 is projected normally on to the plane 21, as indicated at 23 in FIGS. 3 and 4.

The cutter will normally exhibit negative back rake, that is to say it will be inclined forwardly in the direction of rotation of the drill bit as shown in FIGS. 2 and 3, and the cutter may also exhibit side rake, that is to say it may be inclined to face inwardly or outwardly with respect to the axis of rotation of the drill bit. Accordingly, the projection 23 of the cutter on to the plane 21 will normally be an ellipse if the cutter is circular. However, for simplicity, the projections of the cutters are shown as circular in FIG. 4.

The shapes of all the cutters 23 are projected on to the same plane, as shown in FIG. 4, each cutter projection being located at a distance from a first, vertical axis 24 which corresponds to the radial distance of the cutter from the axis of rotation of the drill bit. Each cutter is also located at a vertical distance from a second, horizontal axis 25 corresponding to the distance of the cutter from a plane which is normal to the axis of rotation of the drill bit.

Also projected on the plane is a two-dimensional representation 26 of a datum profile which, in the arrangement shown, is the cutting profile, i.e. is a line joining the cutting tips of the cutter projections 23. Spaced inwardly from the datum profile 26 is a reference profile 27 which may represent a typical amount of wear in the life of the drill bit, or which may represent the actual wear measured from an actual worn drill bit which originally had a datum profile corresponding to the profile 26. The reference profile 27 is not necessarily equidistant from the datum profile 26.

The location of the reference profile 27 may be determined by a number of structural characteristics of the drill bit. Generally speaking, however, it will represent the wear level at which the drill bit would become unusable for one reason or another. For example, the reference profile may represent the point where the size of the wear flats on the cutters takes up an unacceptable amount of the available weight on bit. Also, it may represent the amount of wear at which the cutters no longer cut the formation efficiently.

The total area of the portions of the cutter projections 23 which are located between the datum profile 26 and the reference profile 27 corresponds to the volume of polycrystalline diamond available to be worn away, or actually worn away, in the course of such wear. The diamond volume is the product of the diamond area and the diamond thickness. This volume is measured by dividing the portions of the cutters 23 between the profiles 26 and 27 into a series of vertical strips 28 at radius r from the axis 24 and of a width $\delta r$. The strips 28 may be of any desired width $\delta r$ in relation to the diameter of the cutters, depending on the accuracy required. The total volume may then be calculated by summing the areas of the strips 28. The area of each strip 28 may be correlated to its distance from the axis 24 and the results may be plotted on a graph as shown in FIG. 5. Where strips 28 overlap, as indicated at 28A, the overlapping areas are added together before being correlated with the distance from the axis 24. In FIG. 4 each cutter 23 overlaps only a single cutter in the same region, but arrangements are possible where three or more cutters partly overlap in the same region and in this case the areas of all the overlapping strips are added together.

The actual volume of cutter material is, of course, only proportional to the area of the cutter projections if the material is of uniform thickness. If the thickness varies between different cutters, or varies within a cutter, the calculation of the volume will be required to take this into account. In effect, what is calculated is the volume of cutter material within each cylindrical space of inner radius r and outer radius (r+δr), with respect to the axis 24, and hence with respect to the axis of rotation of the drill bit.

It will be appreciated that the volume of cutter material between the cutting and reference profiles may be calculated in the manner shown in FIG. 4 irrespective of the shape, configuration and location of the cutters. All that is necessary is to calculate the total volume of cutter material between the cutting and reference profiles, and/or to plot the cutter volume between those profiles against distance from the axis 24 as shown in FIG. 5. The method is therefore applicable to drill bits having cutters of any shape, size and configuration, and thus allows the wear characteristics of very different types of cutter arrangement to be compared.

Having calculated the volume of diamond material in the cutters between the datum profile 26 and reference profile 27, it is then advantageous to calculate the predicted wear rate of each region 28 of the cutter assembly and to plot the wear rate against the radius r. Analysis of the curve thus obtained can be used in the design of a drill bit or in the modification of an existing design, as will be described. The predicted wear rate ($WR_r$) at radius r is a function of the volume of diamond ($V_r$) at that radius. However, greater accuracy may be obtained by multiplying $V_r$ by correction factors to account for parameters which may affect the wear rate, such as the wear flat area ($WFA_r$), the abrasion resistance of the superhard material (SMAR), the abrasion resistance of the substrate or the less hard material in which superhard particles are embedded (LHAR), the effect of the shape of the cutting structure, the shape factor (SF) and the orientation of the cutting structure or superhard material (SMO).

Accordingly, the predicted wear rate at radius r may be represented by $$WR_r \propto \frac{V_r}{r} \times \frac{WFA_r}{k_1} \times \frac{k_2}{SMAR} \times \frac{k_3}{LHAR} \times \frac{SF}{k_4} \times \frac{SMO}{k_5}$$

Figure 6:
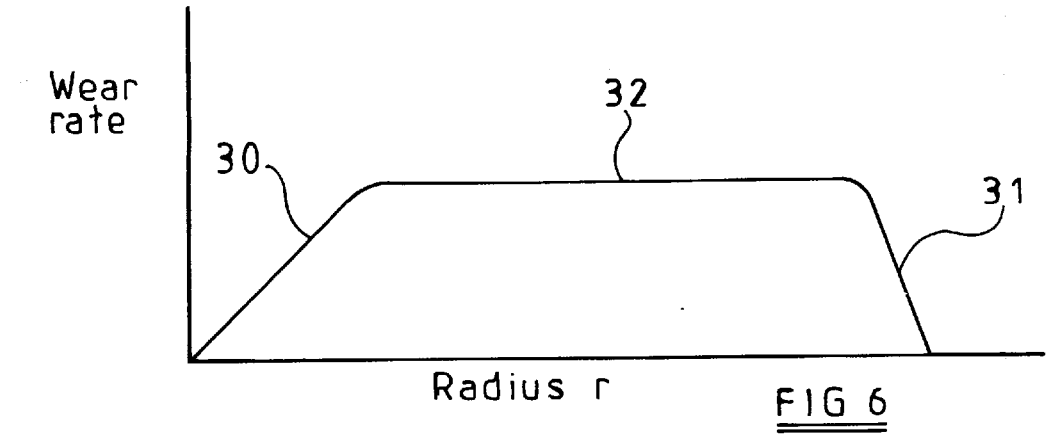
FIG. 6 is a graph showing wear rate plotted against distance from the axis of rotation of the bit.

An idealized plot of wear rate against radius is shown in FIG. 6. In the central part of the drill bit there are normally a large number of cutters to ensure adequate cutter coverage and redundancy and the wear rate in this part of the bit is comparatively low, as indicated by the portion 30 of the curve. There are also additional cutters near the gauge region of the drill bit in order to ensure that the bit does not "lose gauge" and drill an undersized hole. For this reason the wear rate adjacent the gauge drops off to a very low level, due to the large number of cutters, as indicated by the portion 31 of the curve.

In the intermediate part of the curve, as indicated at 32 in FIG. 6, it is desirable for the wear rate to be substantially constant, as shown, so that all the cutters reach the end of their useful life at the same time.

The method of the present invention, as described above, allows the predicted wear rate of a proposed bit design, or the actual wear rate of an actual worn bit, to be plotted against radius, and this enables the wear characteristics of different drill bits to be compared, irrespective of the shape, size and location of the cutting structures and also irrespective of the rate of penetration of the drill bit. Thus, wear rate curves for different proposed designs of drill bit can be compared to see which approximates most closely to the ideal curve shown in FIG. 6. Characteristics of the cutting structures of a proposed bit design, such as their size, shape and relative disposition, may be modified in a manner to vary the shape of the resultant wear rate curve so as to bring it closer to the ideal.

Similarly, the bit design may be modified to vary any of the above-mentioned correction factors and hence change the wear rate so as to approximate more closely to the ideal curve. For example, if the wear rate is significantly above the desired level at a specific radius, the cutters at that radius may be redesigned to reduce one or more of the correction factors which are applicable to the cutting structures in that region, so as to reduce the wear rate of those structures.

It may also be found that the wear rate curve derived from an actual worn drill bit may differ from the predicted wear rate curve for that design of bit, which may have been designed to have a wear rate curve as close to the ideal as possible. In order to compensate for this effect, therefore, amendments may be made to the theoretical design which would alter the shape of the predicted wear rate curve in such a way as might be expected to result in alteration of the wear rate of the actual drill bit in a manner to bring the actual drill bit wear rate curve closer to the ideal.

For example, where the predicted wear rate curve is close to the ideal, but the wear curve of the actual drill bit exhibits a "peak" of excessive wear rate in one region, the theoretical design may be amended so that, on the predicted wear rate curve, the wear rate in that region is less than the ideal wear rate. It should then be found that the effect of this change of design on the actual drill bit is be to bring the actual wear rate curve closer to the ideal by reducing the wear rate in the region where it was previously too high.

This process may be generalized by creating an environmental correction function $k_r$, where $$k_r = \frac{WRA_r}{WRP_r} \quad \text{where}$$

$WRA_r$ = wear rate at radius $r$ on the actual drill bit, and $WRP_r$ = predicted wear rate at radius $r$ The environmental correction may then be added to the calculation of the wear rate in the above-quoted formula as follows:

$$WR_r \propto \frac{V_r}{r} \times \frac{WFA_r}{k_1} \times \frac{k_2}{SMAR} \times \frac{k_3}{LHAR} \times \frac{SF}{k_4} \times \frac{SMO}{k_5} \times k_r$$

As previously mentioned, in prior art wear rate prediction methods, and in the simplest method according to the present invention, it is assumed that the wear rate remains substantially constant throughout the life of the bit, and the initial wear rate is thus extrapolated for the life of the bit. However, the method of the present invention allows more accurate calculation of the wear rate which allows for variation in the rate of wear as wear progresses. This may be effected by carrying out the steps of the method a number of times in succession with the datum profile being moved closer to the surface of the drill bit in each iteration of the method. Thus, the reference profile employed in the first application of the method does not represent the final wear profile of the bit but represents an intermediate profile. The steps of the method are then repeated with the first reference profile becoming the datum profile and a further datum profile being determined which is closer to the surface of the drill bit. The curves of wear rate plotted from each of the iterations of the method may then be overlaid one upon another to give a full picture of the progressive wear of the bit from the new condition to the fully worn condition.

In the embodiment of the method as described in relation to FIGS. 4 and 5, the cutting structures of the drill bit were circular preform cutting elements of the same diameter with their cutting edges all lying on the datum profile, which was also the cutting profile of the drill bit. While many drill bits are of this basic configuration, the method of the invention is also applicable to drill bits having any shape and configuration of cutting elements and to drag-type drill bits having cutting structures of virtually any other form. Indeed, it is one of the main advantages of the present invention that, because it is applicable to a wide range of types of cutting structure, it enables the wear characteristics of drill bits having different cutting structure configurations to be compared. FIGS. 7–10 are therefore similar views to FIG. 4 showing application of the method to some other cutting structure configurations.

Figure 7:
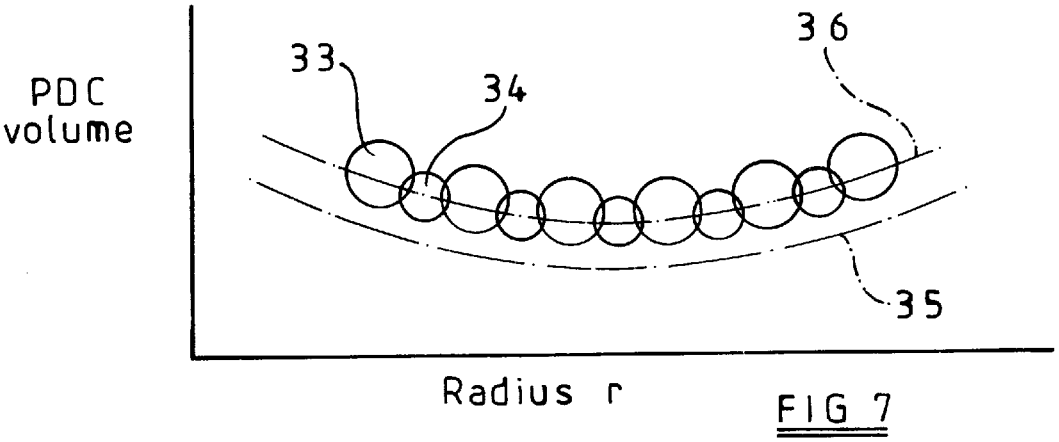
FIGS. 7 to 10 are similar views to FIG. 4 of other cutting structure configurations.

In FIG. 7 the cutters are circular preform cutters of different diameters, comprising larger cutters 33 and smaller cutters 34. In this instance the datum profile 35 is not the same as the cutting profile and is not tangential to the cutting edges of the cutting elements but is spaced outwardly from those cutting edges. The reference profile 36, however, again represents the point of maximum permitted wear of the drill bit.

Figure 8:
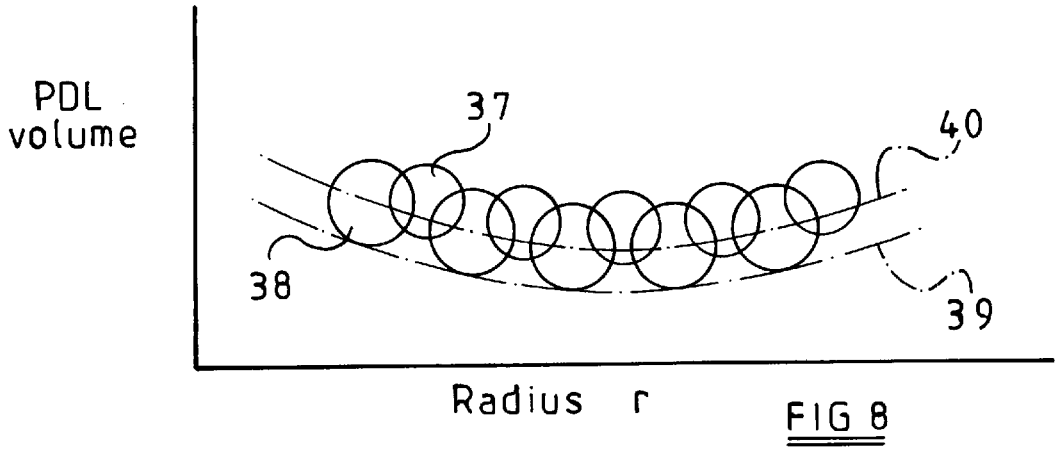

In the arrangement of FIG. 8 the smaller preform cutters 37 are located closer to the surface of the bit body than the larger cutters 38 so that the datum profile 39 is tangential to the cutting edges of the larger cutters 38 but is spaced outwardly of the cutting edges of the smaller cutters 37. The reference profile is indicated 40.

Figure 9:
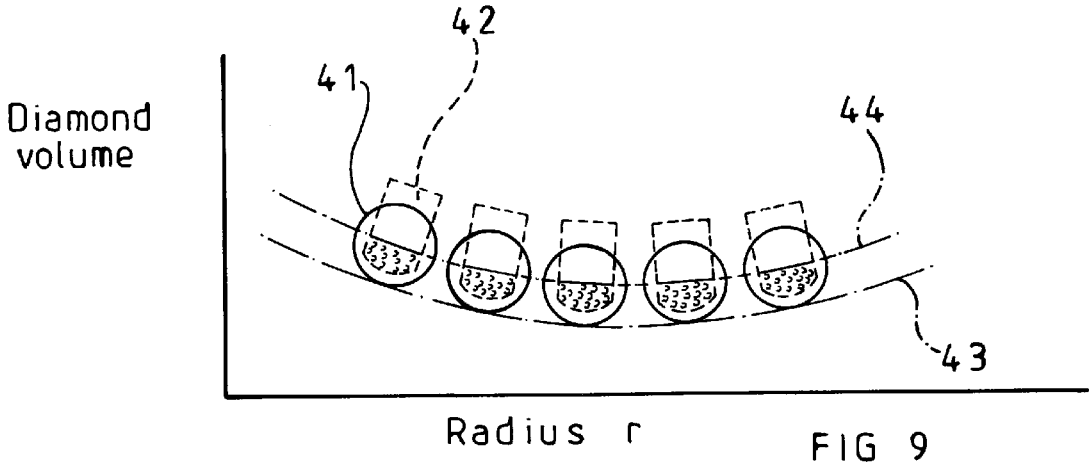

As previously mentioned, the invention is applicable to other types of cutting structure and FIG. 9 shows an arrangement where circular preform cutters 41 are backed up by impregnated cutters 42 each comprising particles or small bodies of superhard material, such as natural or synthetic diamond, embedded in a body of less hard material, such as tungsten carbide. It is common in such arrangements for the primary cutters 41 to project from the bit body by a slightly greater distance than the back-up elements 42. In this arrangement a typical datum profile is indicated at 43 and a typical reference profile at 44.

Figure 10:
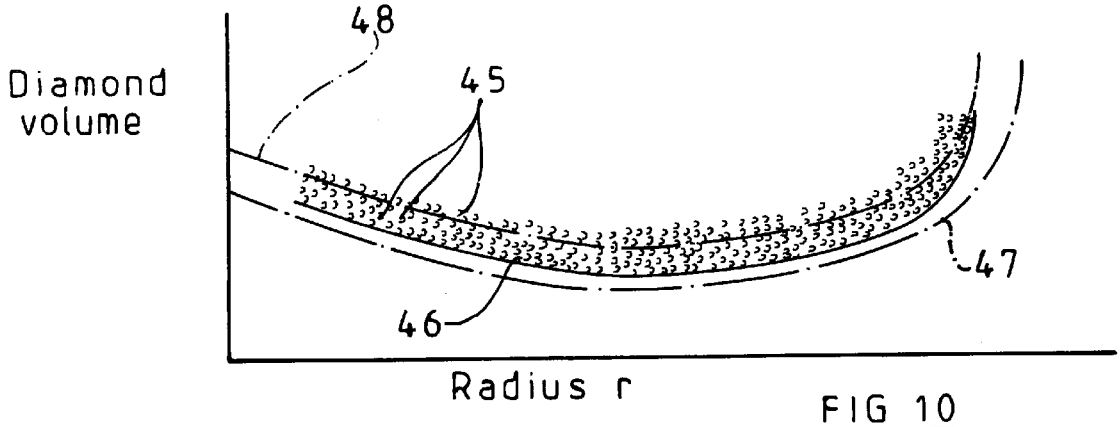

FIG. 10 shows an arrangement where the bit body is covered with a substantially continuous layer of cutting material comprising particles or small bodies 45 of superhard material, such as natural or synthetic diamond, embedded in a matrix 46, for example a solid infiltrated matrix of tungsten carbide. In this case the datum profile 47 may be spaced a short distance outwardly from the surface of the cutting layer, and the reference profile is located inwardly of the surface of the cutting layer, representing a typical wear level.

In each of the arrangements of FIGS. 6 to 10 the volumes and wear rates of narrow annular regions of the cutting structures are calculated in the same manner as described in relation to FIG. 4.

In cases where the cutting structures comprise superhard particles or small bodies embedded in a less hard layer, the volume of cutter material determined by the first step of the method according to the invention will be the volume of superhard material incorporated in the cutting structures. Generally speaking the percentage volume of superhard material embedded within the cutter material will be known, enabling the volume of superhard material to be calculated by first calculating the total volume of regions of the cutter material. In the arrangement of FIG. 10, the wear rate at any particular region of the drill bit may be adjusted by varying the percentage of superhard material in the cutting structure in that region. Obviously, increasing the percentage of superhard material in any particular region will decrease the wear rate in that region.

In the case of superhard material impregnated cutters, as shown in FIG. 9, the wear rate in different regions of the drill bit may be varied by varying the number of impregnated cutters in a region, as was the case with preform cutters, but the wear rate may also be varied by using impregnated cutters having a greater or lesser percentage of superhard material. In either case the wear rate may also be varied by varying the abrasion resistance of the superhard material employed.

As previously explained, the steps of the method according to the invention will normally be carried out by use of an appropriate computer program and the program will be designed to provide an output of the required information in any suitable form. For example the graphs of the kind shown in FIG. 5 and FIG. 6 may be computer generated.

Whereas the present invention has been described in particular relation to the drawings attached hereto, it should be understood that other and further modifications, apart from those shown or suggested herein, may be made within the scope and spirit of the present invention.

What is claimed:

1. A method of determining wear characteristics of a rotary drag-type drill bit comprising cutting structures on a bit body, the method comprising the steps of:

determining the location and shape of a datum profile for the cutting structures;

determining the location and shape of a reference profile located inwardly of the datum profile with respect to the bit body;

then calculating a volume of the cutting structure material between the datum profile and the reference profile; and correlating said volume to a corresponding wear rate of said drill bit.

2. A method according to claim 1, wherein the cutting structures have outer extremities relative to the bit body and the datum profile is no closer to the bit body than the outer extremities of the cutting structures.

3. A method according to claim 2, wherein the datum profile is generally tangential to the outer extremities of at least some of said cutting structures.

4. A method according to claim 1, wherein the cutting structures include discrete cutters separately mounted on the bit body.

5. A method according to claim 4, wherein each cutter comprises a layer of superhard material bonded to a less hard substrate, and said volume of cutter material comprises the volume of the superhard material on said cutters between the datum profile and the reference profile.

6. A method according to claim 4, wherein each cutter comprises particles of superhard material embedded in a body of less hard material.

7. A method according to claim 6, wherein said volume of cutter material comprises the volume of the superhard material in said cutters between the datum profile and the reference profile.

8. A method according to claim 4, wherein said cutters include both cutters comprising a layer of superhard material bonded to a less hard substrate, and cutters comprising particles of superhard material embedded in a body of less hard material.

9. A method according to claim 1, wherein the cutting structures comprise regions of a larger substantially continuous body of cutting material extending over at least a part of the bit body and comprising particles of superhard material embedded in a less hard material.

10. A method according to claim 9, wherein said volume of cutter material comprises the volume of the superhard material in said regions between the datum profile and the reference profile.

11. A method according to claim 1, wherein representations of the components on which the steps of the method are performed are generated by a computer program, and wherein the steps of the method are performed by use of a computer program.

12. A method according to claim 6, wherein the superhard material comprises particles selected from natural and synthetic diamond.

13. A method according to claim 8, wherein the superhard material comprises particles selected from natural and synthetic diamond.

14. A method according to claim 9, wherein the superhard material comprises particles selected from natural and synthetic diamond.

15. A method according to claim 1, wherein the bit body has an axis of rotation and including the further step of correlating said volume of cutting structure material in said cutting structures with distance of said material from the axis of rotation of the bit body.

16. A method according to claim 15, including the step of calculating said volume of cutting structure material between the reference profile and the datum and within a cylindrical space having an inner radius r and an outer radius comprised of r plus a width (r+δr), with respect to the axis of rotation of the drill bit, and plotting said volume against r.

17. A method according to claim 16, including the step of calculating the predicted wear rate $WR_r$ of cutting structure material at radius r as a function of the volume and plotting said predicted wear rate against r.

18. A method according to claim 17, including the step of multiplying the calculated predicted wear rate by at least one correction factor selected from correction factors to account for: wear flat area, superhard material abrasion-resistance, less hard material abrasion resistance, shape factor, and superhard material orientation.

19. A method according to claim 18, including the step of adjusting at least one of said correction factors, by modification of the bit design, to produce a desired curve of predicted wear rate plotted against r.

20. A method according to claim 17, including the step of comparing the curve of predicted wear rate plotted against r with a corresponding curve of actual wear rate plotted against r for an actual drill bit, and modifying the bit design in a manner to address wear patterns in the predicted wear curve which are uncharacteristic of the actual drill bit.

21. A method according to claim 1, wherein the location and shape of the reference profile is determined by applying an offset to the datum profile.

22. A method according to claim 21, wherein the reference profile is offset from the datum profile by distances which are equal for all parts of the datum profile.

23. A method according to claim 1, wherein the location and shape of the reference profile are measured from the cutters of an actual worn drill bit, the datum profile being determined from a stored representation of the datum profile of the same bit before such wear occurred.

24. A method according to claim 1, wherein the surface profile of the bit body itself is used as the reference profile.

25. A method according to claim 1, wherein the shape and location of the reference profile corresponds to a total wear flat area of the cutting structures which would represent the limit of practical use of an actual drill bit according to the design.

26. A method according to claim 1, wherein the steps of the method are repeated, the datum profile of each subsequent series of steps having the shape and location of the reference profile in the immediately preceding series of steps.

* * * * *

UNITED STATES PATENT AND TRADEMARK OFFICE

CERTIFICATE OF CORRECTION

PATENT NO. : 6,151,960
DATED : November 28, 2000
INVENTOR(S) : Taylor et al.

It is certified that error appears in the above-identified patent and that said Letters Patent is hereby corrected as shown below:

Title page,
Item [*] Notice: delete the phrase “by 0 days” and insert -- by 4 days --

Signed and Sealed this

Eighteenth Day of May, 2004

JON W. DUDAS
*Acting Director of the United States Patent and Trademark Office*